US010053760B2

(12) United States Patent
Ludtka et al.

(10) Patent No.: US 10,053,760 B2
(45) Date of Patent: Aug. 21, 2018

(54) METHOD OF THERMOMAGNETICALLY PROCESSING AN ALUMINUM ALLOY

(71) Applicant: UT-Battelle, LLC, Oak Ridge, TN (US)

(72) Inventors: Gerard M. Ludtka, Oak Ridge, TN (US); Orlando Rios, Knoxville, TN (US); David Weiss, Manitowoc, WI (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 0 days.

(21) Appl. No.: 15/424,033

(22) Filed: Feb. 3, 2017

(65) Prior Publication Data

US 2017/0226617 A1 Aug. 10, 2017

Related U.S. Application Data

(60) Provisional application No. 62/291,578, filed on Feb. 5, 2016.

(51) Int. Cl.

| | |
|---|---|
| ***C22F 3/00*** | (2006.01) |
| ***C22C 21/16*** | (2006.01) |
| ***C22C 21/18*** | (2006.01) |
| ***C22C 21/14*** | (2006.01) |
| ***C22C 21/10*** | (2006.01) |
| ***C22F 1/057*** | (2006.01) |
| ***C22F 1/053*** | (2006.01) |

(52) U.S. Cl.

CPC ..... *C22F 3/00* (2013.01); *C22C 21/10* (2013.01); *C22C 21/14* (2013.01); *C22C 21/16* (2013.01); *C22C 21/18* (2013.01); *C22F 1/053* (2013.01); *C22F 1/057* (2013.01)

(58) Field of Classification Search

None

See application file for complete search history.

(56) References Cited

U.S. PATENT DOCUMENTS

| | | | |
|---|---|---|---|
| 6,773,513 | B2 | 8/2004 | Ludtka |
| 7,161,124 | B2 | 1/2007 | Kisner et al. |
| 7,534,980 | B2 | 5/2009 | Wilgen et al. |
| 7,745,765 | B2 | 6/2010 | Kisner et al. |
| 8,795,444 | B1 | 8/2014 | Kisner et al. |
| 9,217,187 | B2 | 12/2015 | Brady et al. |

FOREIGN PATENT DOCUMENTS

CN 103614673 A * 3/2014

OTHER PUBLICATIONS

Ageing behavior of Super-saturated Al-4% Cu alloys under high magnetic field Cui Li-ying, Li Xiao-na, Qi min The Chnese Journal of Nonferrous Metals (vol. 17 No. 12) Published on Dec. 2007.*

Effects of High magnetic field on the evalutions of constituent phases in 7085 aluminum alloy during homogenization Lizi He, Xiehua Li, Pei Zhu Materials Characterization 71 (2012) 19-23.*

ASM Handbook vol. 4: Heat treating of Aluminum alloys Published 1991, p. 841-879.*

Wikipedia (https://en.wikipedia.org/wiki/Aluminium_alloy#Cast_alloys ).*

Mary Anne Tupta. "Measuring the resistivity of bulk materials", Jan. 2011, Electronic Engineering Times Europe, pp. 21-24 (Year: 2011).*

Wikipedia page of Aluminum alloy, Published on Dec. 18, 2011 (Year: 2011).*

Hossain, A. et al., Optimization of Artificial Ageing Time and Temperature on Evaluation of Hardness and Resistivity of Al—Si—Mg (Cu or/& Ni) Alloys, *Inter. J. Chemical, Molecular, Nuclear, Materials and Metallurgical Engineering*, 8, 4 (2014) pp. 319-324.

Ludtka, G.M. et al., "Final Technical Report: Magnetic Field Processing—A Heat Free Heat Treating Method," Oak Ridge National Laboratory, Oak Ridge, TN (Aug. 8, 2012) pp. 1-73, available from U.S. Department of Energy Information Bridge: www.osti.gov/bridge.

Ludtka, G.M. et al., "In Situ Evidence of Enhanced Transformation Kinetics in a Medium Carbon Steel Due to a High Magnetic Field," *Scripta Materialia*, 51 (2004) pp. 171-174.

Nicholson, D.M.C. et al., "The Effect of High Magnetic Field on Phase Stability in Fe—Ni," *Journal of Applied Physics*, 95 11 (2004) pp. 6580-6582.

Olafsson, P. et al., "Comparison of Experimental, Calculated and Observed Values for Electrical and Thermal Conductivity of Aluminium Alloys," *J. Materials Science*, 33 (1997) 4383-4390.

"Aluminum and Aluminum Alloy Castings," *Casting*, vol. 15, ASM Handbook, ASM International (2008) pp. 1059-1084.

"Heat Treating of Aluminum Alloys," *Heat Treating*, vol. 4, ASM Handbook, ASM International (1991) pp. 841-879.

"Properties of Wrought Aluminum and Aluminum Alloys," *Properties and Selection: Nonferrous Alloys and Special-Purpose Materials*, vol. 2, ASM Handbook, ASM International (1990) pp. 62-122.

Liu, X. et al., "Influence of a Low-Frequency Electromagnetic Field on Precipitation Behavior of a High Strength Aluminum Alloy," *Materials Science and Engineering A*, 402 (2005) pp. 1-4.

Watanabe, T., et al., "A New Challenge: Grain Boundary Engineering for Advanced Materials by Magnetic field Application," *Journal of Materials Science*, 41 (2006) pp. 7747-7759.

* cited by examiner

*Primary Examiner* — Jenny R Wu

(74) *Attorney, Agent, or Firm* — Brinks Gilson & Lione

(57) ABSTRACT

A method of thermomagnetically processing an aluminum alloy entails heat treating an aluminum alloy, and applying a high field strength magnetic field of at least about 2 Tesla to the aluminum alloy during the heat treating. The heat treating and the application of the high field strength magnetic field are carried out for a treatment time sufficient to achieve a predetermined standard strength of the aluminum alloy, and the treatment time is reduced by at least about 50% compared to heat treating the aluminum alloy without the magnetic field.

8 Claims, 4 Drawing Sheets

METHOD OF THERMOMAGNETICALLY PROCESSING AN ALUMINUM ALLOY

RELATED APPLICATIONS

The present patent document claims the benefit of priority under 35 U.S.C. § 119(e) to U.S. Provisional Patent Application Ser. No. 62/291,578, filed on Feb. 5, 2016, which is hereby incorporated by reference in its entirety.

FEDERALLY SPONSORED RESEARCH OR DEVELOPMENT

This invention described in this disclosure arose in the performance of Prime Contract No. DE-AC05-00OR22725 between UT-Battelle, LLC and the U.S. Department of Energy. The government has certain rights in the invention.

NAMES OF PARTIES TO A JOINT RESEARCH AGREEMENT

This invention was made under joint research agreement no. MDF-13-0597 between UT-Battelle, LLC and Eck Industries, Inc.

TECHNICAL FIELD

The present disclosure is related generally to the processing of aluminum alloys, and more particularly to the application of a magnetic field during elevated temperature processing of aluminum alloys.

BACKGROUND

Heat treating is a crucial step in the manufacturing process of aluminum alloys to achieve strength and durability. The heat treatment of aluminum alloys can require precise control of the time-temperature profile and tight temperature uniformity to achieve repeatable, high-quality results. Widely used specifications from professional associations such as ASM International (formerly the American Society for Metals) detail heat-treatment processes such as aging, annealing, and solution heat treating in addition to parameters such as times, temperatures, and quenchants.

The total energy input associated with heat treating aluminum castings to fabricate high-strength aluminum alloy components adds considerable costs to manufacturing. Efforts have been made with limited success to reduce the thermal processing times and the energy requirements associated with post-casting heat treatments without a loss of performance of the component. Ideally, the savings of cost and time may be directly measurable and enable lower cost components with a reduction in energy consumption. A problem to be solved is the development of technology to reduce energy consumption and the cost of manufacturing and to deliver lightweight components with properties that meet or exceed those previously achievable.

BRIEF SUMMARY

According to one embodiment, a method of thermomagnetically processing an aluminum alloy entails heat treating an aluminum alloy, and applying a high field strength magnetic field of at least about 2 Tesla to the aluminum alloy during the heat treating. The heat treating and the application of the high field strength magnetic field are carried out for a treatment time sufficient to achieve a predetermined standard strength of the aluminum alloy, and the treatment time is reduced by at least about 50% compared to heat treating the aluminum alloy without the magnetic field.

According to another embodiment, a method of thermomagnetically processing an aluminum alloy entails heat treating an aluminum alloy, and applying a high field strength magnetic field of at least about 2 Tesla to the aluminum alloy during the heat treating. The heat treating and the application of the high field strength magnetic field are carried out for a treatment time sufficient to achieve a maximum value of resistivity for the aluminum alloy, and the treatment time is reduced by at least about 50% compared to heat treating the aluminum alloy without the magnetic field.

DETAILED DESCRIPTION

Figure 1:
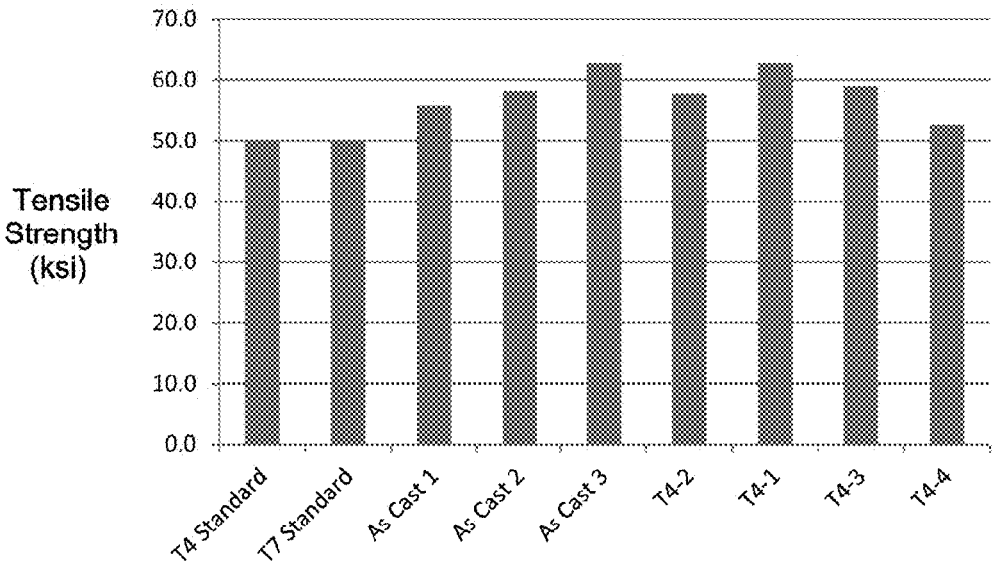
FIG. 1 shows tensile strength data obtained from exemplary aluminum alloy samples after various heat treatments with and without a high strength magnetic field, as summarized in Tables 1 and 2.

Work in ferrous materials has demonstrated the modification of kinetics, phase equilibria and solubility limits using high magnetic field processing. These processing modifications can result in modified microstructures that may retain alloying elements in solution, negating the need for a solution heat treatment, or may increase maximum solid solubility limits, which may improve the strength of the alloy. New investigations of aluminum alloys described herein show that exposure to a high magnetic field during heat treatment can drastically reduce heat treatment times without a sacrifice in the mechanical properties of the treated alloy. Reduced thermal processing times lead to reduced energy requirements, which may translate into lower manufacturing costs.

An improved method of thermomagnetically processing an aluminum alloy entails heat treating the aluminum alloy and applying a high field strength magnetic field of at least about 2 Tesla to the alloy during the heat treatment. The heat treating and the application of the high field strength magnetic field may be carried out for a treatment time sufficient to achieve a predetermined standard strength of the aluminum alloy. The term "predetermined standard strength" may refer to values of yield strength and/or ultimate tensile strength (UTS) for the aluminum alloy as set forth by the Aluminum Association and/or ASM International. Advantageously, the treatment time, which is sufficient to achieve the predetermined standard strength, is reduced by at least about 50% compared to heat treating the aluminum alloy without the magnetic field. In some cases, the treatment time may be reduced by at least about 75%. In other words, due to the thermomagnetic processing, the treatment time may be reduced by at least about 50%, or by at least about 75%, compared to a standard heat treatment time. Generally speaking, when "standard" is used in this disclosure as a modifier for a property or process parameter (e.g., standard strength, standard heat treatment time), it may be understood that the property or process parameter may have a value or range of values as defined by the Aluminum Association and/or ASM International, as discussed below.

The heat treating of the aluminum alloy while exposed to the magnetic field may include one or both of solution heat treating, which is also known as solution treating or solutionizing, and aging, which is also known as age hardening. Solution heat treating is carried out to induce one or more alloying elements in the aluminum alloy to enter into solid solution. After solution treating, rapid cooling (quenching) may be carried out, typically to room temperature, to obtain a supersaturated solid solution. Aging is employed to promote the formation of precipitates from the supersaturated solid solution that serve to harden and strengthen the aluminum alloy. The heat treating may be carried out for a treatment time of about four hours or less, or about two hours or less, depending on whether or not the processing includes one or both of solution heat treating and aging.

To understand the advantage of the thermomagnetic processing method described in this disclosure, it is helpful to consider the heat treat times required of a commercial aluminum alloy (e.g., a cast A206 aluminum alloy) when a magnetic field is not employed. The microstructure of the A206 aluminum alloy shows significant amounts of copper in the eutectic phase. Typically, a long solution treatment (e.g., 8-12 hours) at a high temperature (e.g., about 530° C.) is required to dissolve the copper, which is then captured in a supersaturated solid solution during a quench, followed by at least four hours of aging at 200° C. to form a finely dispersed precipitate at the grain boundaries. Even longer heat treat times are required to meet mechanical property requirements in heavy sections.

When the inventive thermomagnetic process is applied to the A206 aluminum alloy (or to another aluminum alloy as discussed below), solution treating and/or aging may be completed in a fraction of these times. The solution heat treating of the aluminum alloy during exposure to a high field strength magnetic field as described herein may take place at a solution treatment time that is reduced by at least about 75% compared to standard solution treatment times (or to solution treatment times without the magnetic field), but is still sufficient to dissolve the copper and/or other alloying elements in the aluminum alloy. The solution treatment may also be reduced by at least about 80% compared to standard solution treatment times. For example, the solution treatment time may be about 2 hours or less, about 1.5 hours or less, or about 1 hour or less, and is typically at least about 20 minutes or at least about 30 minutes. The temperature at which the solution treating is carried out during the thermomagnetic process is comparable to standard solution treatment temperatures and may be in the range from about 500° C. to about 600° C.

Similarly, the aging of the aluminum alloy while under exposure to a magnetic field of at least about 2 Tesla may take place at an aging time that is reduced by at least about 50% compared to standard aging times (or to aging times without a magnetic field), but is still sufficient to form the desired dispersion of strengthening precipitates. The aging time may also be reduced by at least about 60% compared to standard aging times. For example, the aging time may be about 2 hours or less, about 1.5 hours or less, about 1 hour or less, or about 30 minutes or less, and is typically at least about 10 minutes or at least about 15 minutes. The temperature at which the aging is carried out during the thermomagnetic process is comparable to standard aging temperatures and may be in the range from about 150° C. to about 250° C.

The thermomagnetic processing may be carried out in an apparatus that includes a high field strength magnet, such as a superconducting magnet, and is equipped for heating and cooling a sample positioned within the apparatus (e.g., in the bore of the magnet). Such an apparatus is described in, for example, U.S. Pat. No. 7,745,765, entitled "Thermal and High Magnetic Field Treatment of Materials and Associated Apparatus," which issued on Jun. 29, 2010, to Kisner, et al. and is hereby incorporated by reference. The high field strength magnetic field may be at least about 2 T, at least about 4 T, at least about 6 T, at least about 8 T or at least about 10 T, and is typically no greater than about 20 T.

The aluminum alloy that undergoes the above-described thermomagnetic processing may be a cast or wrought aluminum alloy. In some embodiments, the aluminum alloy may include from about 1 wt. % to about 6 wt. % copper (Cu). Generally speaking, the aluminum alloy may include one or more alloying elements selected from among the following: Bi, Cd, Ce, Cr, Cu, Fe, Li, Mn, Mg, Ni, Ti, Zn, Sn, Si, V and Zr. Suitable cast aluminum alloys may be those having an Aluminum Association designation of 201, 206, 208, 242, 319, 355 or 390, and suitable wrought alloys may have an Aluminum Association designation of 2014, 2024, 7068, 7075 or 7178. Other aluminum alloys, such as Al—Ce alloys, may also benefit from the thermomagnetic process.

The predetermined standard strength referred to above may be determined from one of the following documents or from another resource that sets forth standard values of mechanical properties for cast and/or wrought aluminum alloys: "Properties of Aluminum Casting Alloys," *Casting*, Vol. 15, *ASM Handbook*, ASM International, 2008, p. 1059-1084, or "Properties of Wrought Aluminum and Aluminum Alloys," *Properties and Selection: Nonferrous Alloys and Special-Purpose Materials*, Vol. 2, ASM Handbook, ASM International, 1990, pp. 62-122. Standard heat treatment times for cast and/or wrought aluminum alloys may be determined from "Heat Treating of Aluminum Alloys," *Heat Treating*, Vol. 4, ASM Handbook, ASM International, 1991, pp. 1861-1928.

To evaluate the new method, aluminum alloy A206 samples of standard chemistry obtained in the as-cast and T4 (solution treated only) conditions underwent thermomagnetic processing to the T7 condition (solution treatment plus aging). A horizontal magnet with a 5-inch bore was employed at a magnetic field strength of 9 Tesla. The T4 and T7 nomenclature used above corresponds to standard temper practices and designations as defined by the Aluminum Association.

Figure 2:
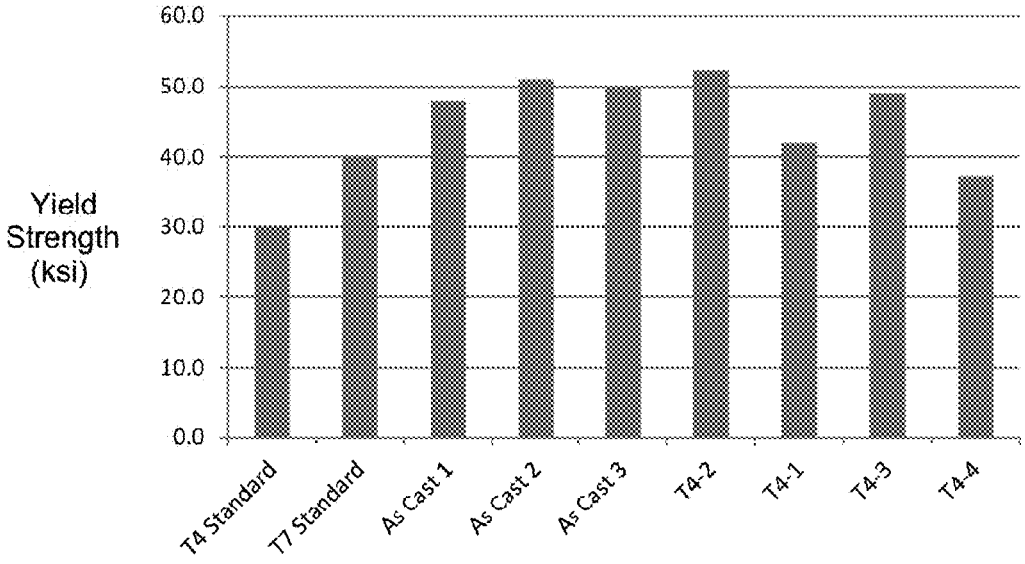
FIG. 2 shows yield strength data obtained from exemplary aluminum alloy samples after various heat treatments with and without a high strength magnetic field, as summarized in Tables 1 and 2.
Figure 3:
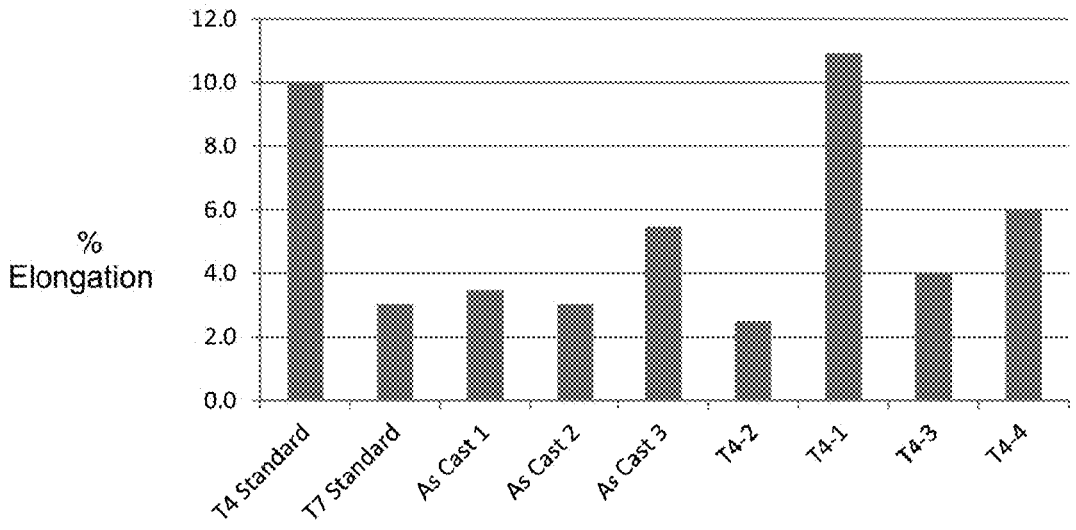
FIG. 3 shows % elongation data obtained from exemplary aluminum alloy samples after various heat treatments with and without a high strength magnetic field, as summarized in Tables 1 and 2.

The as-cast samples underwent a solution treatment at either 510° C. or 530° C. for two hours. Aging times for solution treated samples in the T4 condition were varied among 30 minutes, one hour and two hours to determine the impact of reduced treatment times during exposure to the magnetic field, as summarized in Tables 1 and Table 2. Processed samples were then tested for tensile strength, yield strength and % elongation using mechanical test methods known in the art. The results of the mechanical tests are summarized in Table 1 and in FIGS. 1-3.

TABLE 1

Treatment Times and Conditions with Mechanical Properties

| Alloy ID | Solution Time (s) | Solution Field | Aging Time (s) | Aging Field | Tensile strength (ksi) | Yield Strength (ksi) | Elongation % |
|---|---|---|---|---|---|---|---|
| T4 Standard | 600 | None | N/A | N/A | 50.0 | 30.0 | 10.0 |
| T7 Standard | 600 | None | 840 | None | 50.0 | 40.0 | 3.0 |
| As Cast 1 | 120 | 9 T | N/A | N/A | 55.9 | 47.8 | 3.5 |
| As Cast 2 | 120 | 9 T | 120 | 9 T | 58.2 | 51.1 | 3.0 |
| As Cast 3 | 120 | 9 T | 120 | 9 T | 62.8 | 50.0 | 5.5 |
| T4-2 | 600 | None | 240 | None | 57.8 | 52.3 | 2.5 |
| T4-1 | 240 | None | 30 | 9 T | 62.8 | 42.0 | 10.9 |
| T4-3 | 600 | None | 60 | 9 T | 58.9 | 48.9 | 4.0 |
| T4-4 | 600 | None | 240 | 9 T | 52.6 | 37.3 | 6.0 |

TABLE 2

Summary of Processing Conditions

| Alloy ID | Processing Conditions |
|---|---|
| T4 Standard | 8-12 h at 985° F. (529° C.) |
| T7 Standard | T4 plus 14 h at 200° C. |
| As Cast 2 | T7-530° C., 9 T, 2 h, WQ, 200 C., 2 h |
| As Cast 3 | T7-530° C., 9 T, 2 h, WQ, 200 C., 2 h, FC |
| T4-2 | 510° C. for 2 h, 525° C. for 8 h, WQ and T7-200° C., No field |
| T4-1 | 510° C. for 2 h, 525° C. for 2 h, WQ and T7-200° C., 9 T, 30 min |
| T4-3 | 510° C. for 2 h, 525° C. for 8 h, WQ and T7-200° C., 9 T, 1 h |
| T4-4 | 510° C. for 2 h, 525° C. for 8 h, WQ and T7-200° C., 9 T, 4 h |

WQ = Water Quench

For samples supplied in the as-cast condition, full solution occurred within two hours under the magnetic field, which is less than 20% of the standard 10-hour cycle time. This was verified through the mechanical properties data, which show that ultimate tensile strengths of above 55 ksi (379 MPa) and yield strengths above 47 ksi (324 MPa) can be achieved after significantly reduced solution processing times when a high strength magnetic field is applied.

For samples supplied in the solution treated only (T4) condition that underwent an aging treatment, aging (or precipitation) occurred within 30 minutes or within one hour under the magnetic field, or in less than 25% of the standard 4-hour aging cycle time. This is verified through the mechanical properties data, which show that ultimate tensile strengths above 58 ksi (399 MPa) and yield strengths above 41 ksi (282 MPa) can be achieved after significantly reduced aging times when a high strength magnetic field is applied.

The mechanical properties data suggest that aging times can be even further reduced since in most cases the strength of the samples was higher and the elongation lower than the conventionally processed (T4 and T7 standard) samples. The potential for further reduction in the aging time is supported by resistivity data collected from initial experiments that were used to guide estimates of the rates of precipitation hardening. By tracking the resistivity during heat treatment, it is possible to characterize the microstructural evolution of the alloy. For example, precipitation of a hardening phase is known to increase the voltage of the sample and therefore the resistance, since precipitate interfaces impair current conduction. Subsequent coarsening of the precipitates is known to reduce the voltage and the resistance of the sample.

Figure 4:
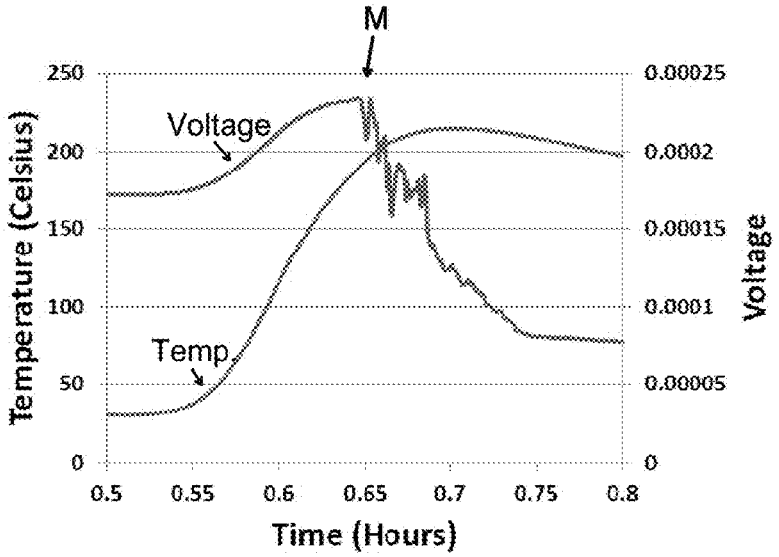
FIG. 4 shows temperature and voltage (determined from resistivity measurements) as a function of time for an exemplary aluminum alloy sample during aging at 200° C. with no applied magnetic field.
Figure 5:
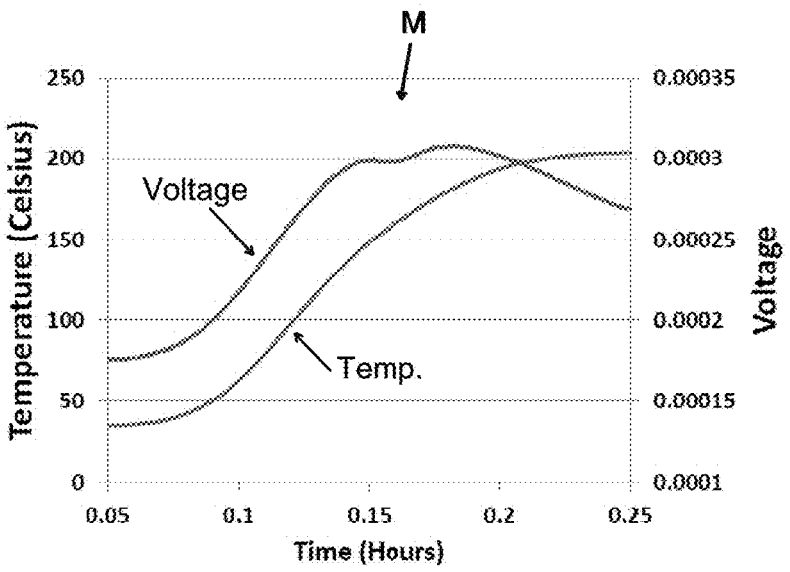
FIG. 5 shows temperature and voltage (determined from resistivity measurements) as a function of aging time for an exemplary aluminum alloy sample during aging at 200° C. while a 9 Tesla magnetic field is applied.

This effect is demonstrated in FIGS. 4 and 5, which show temperature and resistivity data collected for an A206 aluminum alloy sample during aging at 200° C. with (FIG. 5) and without (FIG. 4) an applied magnetic field of 9 Tesla. Of interest is the dramatic difference in resistivity (as reflected by the recorded voltage from V=IR relationship where R is resistance, V is voltage, and I is current) response between field and no-field conditions that suggest the magnetic field causes the precipitation reaction to occur in an accelerated fashion, possibly even during heat-up to the aging temperature. This observation supports the high strength achieved in very short aging times reported in Table 1 for magnetically processed samples.

Thus, according to another embodiment, the thermomagnetic processing method may entail carrying out the heat treating (e.g., aging) and the application of the high field strength magnetic field for a treatment time sufficient to achieve a maximum value of resistivity for the aluminum alloy. The maximum value (M) may correspond to a data point having a slope of zero on an increasing curve of voltage versus treatment time, as indicated in FIGS. 4 and 5. In these examples, the maximum value of voltage/resistivity occurs at a treatment time of nearly 0.65 h when no magnetic field is applied during aging, whereas the treatment time is less than 0.2 h when the magnetic field is applied. The increased resistivity is a consequence of scattering of electrons, which increases with the formation of precipitates. The more rapid rise when the magnetic field is applied provides evidence of enhanced formation of coherent precipitates during thermomagnetic processing. Furthermore, after the initial rise, the voltage remains at a higher value when the magnetic field is applied (FIG. 5) than in the no-field case (FIG. 4), where a significant decrease in voltage is observed. The higher voltage maintained when the magnetic field is applied suggests that the coherent precipitates are maintained and/or continue to form, while the decrease in voltage in the no-field case may be associated with a loss of coherency and coarsening of the precipitates, which can diminish the precipitation hardening effect. In general, the data show that the treatment time to achieve the maximum value of resistivity is reduced by at least about 50%, or at least about 75%, compared to heat treating the aluminum alloy without the magnetic field. In other words, the treatment time with a high field strength magnetic field is reduced by at least about 50% or at least about 75% compared to a standard heat treatment time of the aluminum alloy, as discussed above.

Figure 6:
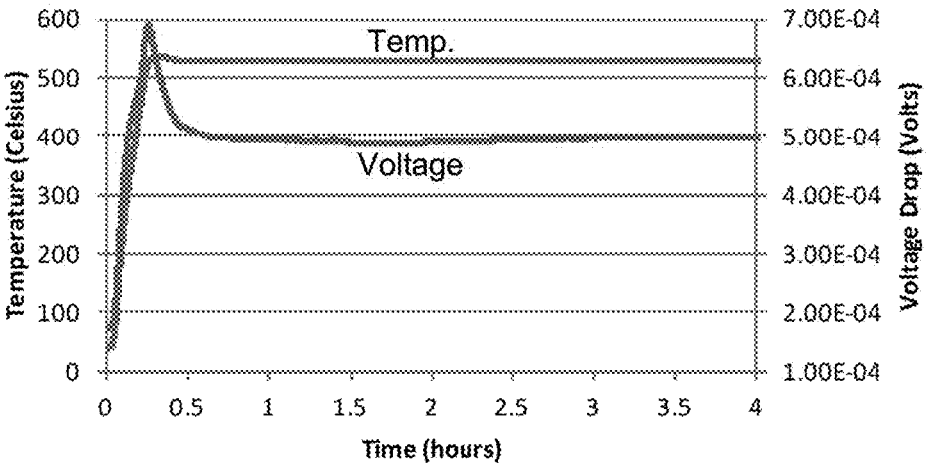
FIG. 6 shows temperature and voltage (determined from resistivity measurements) as a function of time for an exemplary aluminum alloy sample during solution treating at 530° C. with no applied magnetic field.
Figure 7:
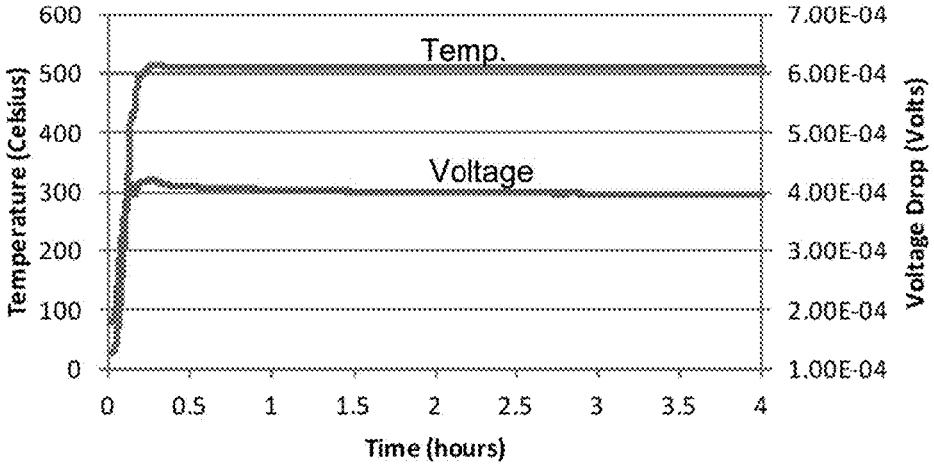
FIG. 7 shows temperature and voltage (determined from resistivity measurements) as a function of time for an exemplary aluminum alloy sample during solution treating at 510° C. while a 9 Tesla magnetic field is applied.

Similarly, during solution treatment with and without a high field strength magnetic field, there are significant differences in the measured resistivity. The results of resistivity measurements obtained during solution heat treatment at 530° C. (or 510° C.) with and without a 9 T magnetic field are shown by the temperature and voltage data of FIG. 6 (no applied field) and FIG. 7 (9 T magnetic field). The absence of the resistance spike during solution treatment when the magnetic field is applied reveals faster dissolution kinetics during heat-up. In other words, there is more significant and effective dissolution of the solute during solution treatment under a high field strength magnetic field than during solution treatment without an applied field. Thus, solutionizing can be carried out in a shorter time duration during the thermomagnetic process.

The aluminum alloy that undergoes the thermomagnetic processing method as described above according to various embodiments may have any of the characteristics described in this disclosure. The heat treating may include one or both of solution heat treating and aging, and may be carried out at the temperatures and time durations described above. Altogether, the heat treating may be carried out for a treatment time of about four hours or less, depending on whether or not the processing includes one or both of solution heat treating and aging. An apparatus as described above that includes a high field strength magnet and is equipped for heating and cooling a sample positioned within the apparatus may be employed to carry out the method according to any embodiment. The resistivity data may be obtained out using procedures known in the art.

Although the present invention has been described in considerable detail with reference to certain embodiments thereof, other embodiments are possible without departing from the present invention. The spirit and scope of the appended claims should not be limited, therefore, to the description of the preferred embodiments contained herein. All embodiments that come within the meaning of the claims, either literally or by equivalence, are intended to be embraced therein.

Furthermore, the advantages described above are not necessarily the only advantages of the invention, and it is not necessarily expected that all of the described advantages will be achieved with every embodiment of the invention.

The invention claimed is:

1. A method of thermomagnetically processing an aluminum alloy, the method comprising:

solution heat treating an aluminum alloy at a temperature in a range from about 500° C. to about 600° C. to induce one or more alloying elements to enter into solid solution in the aluminum alloy;

during the solution heat treating, applying a high field strength magnetic field of at least about 2 Tesla to the aluminum alloy and measuring a voltage of the aluminum alloy to track a resistivity thereof;

continuing the solution heat treating and the application of the high field strength magnetic field for a treatment time to achieve a maximum value of the resistivity for the aluminum alloy; and after the solution heat treating, rapidly cooling the aluminum alloy to obtain a supersaturated solid solution, wherein the treatment time is reduced by at least about 50% compared to solution heat treating the aluminum alloy without the magnetic field.

2. The method of claim 1, wherein the maximum value of the resistivity corresponds to a data point having a slope of zero on an increasing curve of voltage versus treatment time.

3. The method of claim 1, wherein the treatment time is reduced by at least about 75%.

4. The method of claim 1, further comprising:

aging to induce formation of precipitates from the supersaturated solid solution, wherein the aging takes place at an aging time reduced by at least about 50% compared to aging times without a magnetic field.

5. The method of claim 1, wherein the aluminum alloy comprises from about 1 wt. % to about 6 wt. % copper.

6. The method of claim 5, wherein the aluminum alloy further comprises one or more alloying elements selected from the group consisting of: Bi, Cd, Cr, Fe, Li, Mn, Mg, Ni, Ti, Zn, Sn, Si, V and Zr.

7. The method of claim 6, wherein the aluminum alloy is a cast alloy having an Aluminum Association designation selected from the group consisting of: 201, 206, 208, 242, 319, 355 and 390.

8. The method of claim 6, wherein the aluminum alloy is a wrought alloy having an Aluminum Association designation selected from the group consisting of: 2014, 2024, 7068, 7075 and 7178.

* * * * *